US011421444B2

(12) United States Patent
Alvarez Cavazos et al.

(10) Patent No.: US 11,421,444 B2
(45) Date of Patent: Aug. 23, 2022

(54) SYSTEMS AND METHODS FOR ELECTRONICALLY LOCKING HVAC DOORS

(71) Applicant: Johnson Controls Technology Company, Auburn Hills, MI (US)

(72) Inventors: Karla D. Alvarez Cavazos, York, PA (US); Ryan L. Snider, York, PA (US); Nicholas P. Mislak, Bel Air, MD (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 734 days.

(21) Appl. No.: 16/380,810

(22) Filed: Apr. 10, 2019

(65) Prior Publication Data

US 2020/0300000 A1 Sep. 24, 2020

Related U.S. Application Data

(60) Provisional application No. 62/821,870, filed on Mar. 21, 2019.

(51) Int. Cl.
*E05B 47/00* (2006.01)
*F24F 11/00* (2018.01)
(Continued)

(52) U.S. Cl.
CPC ..... *E05B 47/0002* (2013.01); *E05B 35/008* (2013.01); *E05B 65/0003* (2013.01);
(Continued)

(58) Field of Classification Search
CPC ..... Y10T 292/11; Y10T 70/7107; Y10T 70/7057; Y10T 292/1078; E05B 47/0002;
(Continued)

(56) References Cited

U.S. PATENT DOCUMENTS 419,766 A * 1/1890 Glaeser ..... E05B 47/0047 292/341.16
473,061 A * 4/1892 Crockett et al. .... E05B 47/0012 70/279.1
(Continued)

FOREIGN PATENT DOCUMENTS

CA 2652353 A1 * 8/2009 ..... B60J 5/108
CA 2764231 A1 * 12/2010 ..... H02B 1/52
(Continued)

*Primary Examiner* — Mark A Williams
(74) *Attorney, Agent, or Firm* — Fletcher Yoder, P.C.

(57) ABSTRACT

Systems and methods are disclosed that operate a door latch of a door of a heating, ventilation, and/or air conditioning (HVAC) system electronically based on operating a locking engagement device. The locking engagement device may be disposed on an outer portion of a door, the latch may be part of a latching system disposed on an inner portion of the door, and the locking engagement device may transmit a signal indicating that the locking engagement device is in an open or closed position to the latching system via a conductor electronically coupling the locking engagement device and the latching system. In some embodiments, the locking engagement device may transmit a signal indicating that the locking engagement device is in an open or closed position to a controller, which may then instruct the latching system to open or close the latch based on receiving the signal.

23 Claims, 6 Drawing Sheets

(51) Int. Cl.
*F24F 11/89* (2018.01)
*E05B 65/00* (2006.01)
*E05B 35/00* (2006.01)

(52) U.S. Cl.
CPC ..... *F24F 11/00* (2013.01); *F24F 11/89* (2018.01); *E05B 2047/0048* (2013.01); *E05B 2047/0069* (2013.01); *F24F 2221/44* (2013.01)

(58) Field of Classification Search
CPC ..... E05B 47/0006; E05B 47/0038; E05B 47/023; E05B 47/06; E05B 2047/0079; E05B 2047/0086; E05B 81/08; E05B 2047/0048; E05B 2047/0069; E05B 35/008; E05B 65/0003; E05C 19/166; E05C 3/12; E05C 1/08; F24F 13/20; F24F 1/58; F24F 2221/44; F24F 11/89; F24F 11/00
See application file for complete search history.

(56) References Cited

U.S. PATENT DOCUMENTS 580,820 A * 4/1897 Scheeren ..... E05B 47/0002 292/144
608,321 A * 8/1898 Carleton ..... E05B 47/0002 292/144
726,548 A * 4/1903 Lemp ..... B60L 53/14 292/144
897,394 A * 9/1908 Peters ..... E05B 47/0047 292/341.16
1,011,956 A * 12/1911 Hild ..... E05B 47/0002 292/144
2,153,088 A * 4/1939 Knell ..... E05B 47/0607 292/DIG. 3
8,757,677 B2 * 6/2014 Wintersteiger ..... E05B 47/0607 292/201
2007/0039472 A1 * 2/2007 Bias ..... B03C 3/09 96/77
2008/0164385 A1 * 7/2008 Khan ..... F24H 9/02 248/74.1
2010/0175631 A1 * 7/2010 Bennatt ..... A01K 1/033 119/475
2013/0063382 A1 * 3/2013 Feldstein ..... H04L 12/282 361/679.01
2015/0115629 A1 * 4/2015 Gartner ..... E05B 65/0082 292/220
2016/0097220 A1 * 4/2016 Woodling ..... E05B 47/0673 70/278.7
2016/0251883 A1 * 9/2016 Wang ..... D06F 39/14 292/179
2016/0305157 A1 * 10/2016 Sims ..... E05B 47/0047
2017/0363319 A1 * 12/2017 Long ..... B61D 27/00
2020/0063989 A1 * 2/2020 Salunkhe ..... E05C 5/04
2021/0207821 A1 * 7/2021 Kadu ..... F24F 1/56

FOREIGN PATENT DOCUMENTS

CA 2693874 A1 * 7/2011 ..... G06Q 10/08
CA 3062280 A1 * 11/2018 ..... B28B 11/247
CN 111877883 A * 11/2020
FR 2667495 A1 * 4/1992 ..... A47G 29/1201

* cited by examiner

SYSTEMS AND METHODS FOR ELECTRONICALLY LOCKING HVAC DOORS

CROSS REFERENCE TO RELATED APPLICATIONS

This application claims priority from and the benefit of U.S. Provisional Application Ser. No. 62/821,870, entitled "SYSTEMS AND METHODS FOR ELECTRONICALLY LOCKING HVAC DOORS," filed Mar. 21, 2019, which is hereby incorporated by reference in its entirety for all purposes.

BACKGROUND

The present disclosure generally relates to a heating, ventilation, and/or air conditioning (HVAC) system and, more particularly, to an electronic door latch for the HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

An HVAC system may include components that are accessible via doors for maintenance or configuration purposes. The doors may be secured by a lock to ensure that only appropriate people, such as service personnel or owners of the HVAC system, having keys to the lock may access the components. Because the doors may include inner portions that are exposed to the conditioned environment and outer portions that are exposed to an ambient, unconditioned environment, the doors may be insulated to prevent conditioned air from escaping from the conditioned environment to the ambient environment. However, because the locks may include metal parts that extend through the doors, such as cylinders, shafts, or lock bodies where the keys are inserted, these metal parts may create a thermal bridge from the conditioned environment to the ambient environment for conditioned air to escape, resulting in a loss of efficiency.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and air conditioning (HVAC) system includes a housing that contains components of the HVAC system and includes a door that enables access to the components of the HVAC system. The door includes an outer portion having a locking engagement device and an inner portion having a latching system. The latching system includes a latch that prevents the door from opening when engaged. The door also includes a conductor electrically coupling the locking engagement device to the latching system. The latching system disengages the latch in response to the locking engagement device being in a first position and engages the latch in response to the locking engagement device being in a second position.

In another embodiment, an electronic locking device of a door of an HVAC system includes a locking engagement device disposed on an outer portion of the door and a latching system disposed on an inner portion of the door. The latching system includes a latch and operates the latch to prevent the door from opening when the latch is engaged. The electronic locking device also includes a conductor electrically coupling the locking engagement device to the latching system. The latching system disengages the latch in response to the locking engagement device being in a first position and engages the latch in response to the locking engagement device being in a second position.

In yet another embodiment, a locking engagement device is disposed on an outer portion of a door of an HVAC system. The electronic locking device includes a receptacle that enables insertion of a key. The locking engagement device rotates in response to the key being inserted in the receptacle and rotated. The electronic locking device also includes a conductor that electrically couples the locking engagement device to a latching system disposed on an inner portion of the door. The locking engagement device sends a first indication of being in a first position to the latching system via the conductor in response to the locking engagement device being rotated into the first position. The locking engagement device also sends a second indication of being in a second position to the latching system via the conductor in response to the locking engagement device being rotated into the second position.

BRIEF DESCRIPTION OF THE DRAWINGS

Various aspects of the present disclosure may be better understood upon reading the following detailed description and upon reference to the drawings, in which.

DETAILED DESCRIPTION

Figure 1:
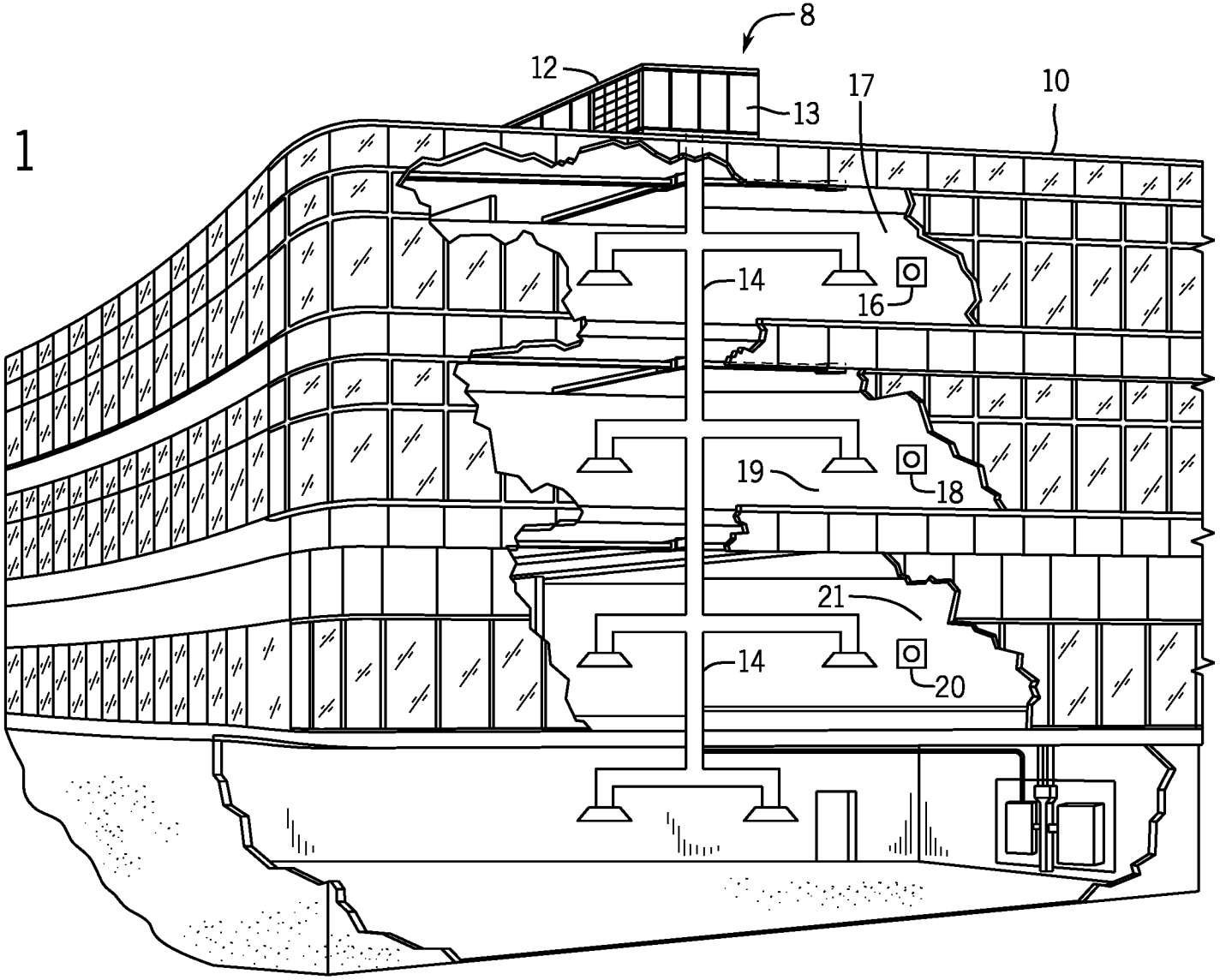
FIG. 1 illustrates a heating, ventilation, and/or air conditioning (HVAC) system for building environmental management that may employ one or more HVAC units, in accordance with an embodiment of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or some embodiments" of the present disclosure are not intended to be interpreted as excluding the existence of additional embodiments that also incorporate the recited features.

An HVAC system may include components that are accessible via doors for maintenance or configuration purposes. For example, the HVAC system may include a rooftop unit cabinet that houses components used to provide conditioned air to a building or structure. The doors may be secured by a lock to ensure that only appropriate people, such as service personnel or owners of the HVAC system, having keys to the lock may access the components. Because the doors may include inner portions that are exposed to the conditioned environment and outer portions that are exposed to an ambient, unconditioned environment, the doors may be insulated to prevent conditioned air from escaping from the conditioned environment to the ambient environment. However, because the locks may include metal parts that extend through the doors, such as cylinders, shafts, or lock bodies where the keys are inserted, these metal parts may create a thermal bridge from the conditioned environment to the ambient environment for conditioned air to escape, resulting in a loss of efficiency. Moreover, when the ambient environment is sufficiently warm or humid compared to the conditioned environment, undesirable condensation may form, for example, on an outer portion of the door and/or on the lock engagement device. While the metal parts of the locks may be replaced with plastic or non-metal materials, using such replacements may not be practical due to the expense of manufacturing and/or molding the plastic or non-metal materials or lack durability.

Accordingly, the present disclosure provides systems and methods that operate a door latch electronically based on operating a locking engagement device. The locking engagement device may be disposed on an outer portion of a door, the latch may be part of a latching system disposed on an inner portion of the door, and the locking engagement device may transmit a signal indicating that the locking engagement device is in an open or closed position to the latching system via a conductor electronically coupling the locking engagement device and the latching system. In some embodiments, the locking engagement device may transmit a signal indicating that the locking engagement device is in an open or closed position to a controller, which may then instruct one or more latching systems to engage or disengage one or more latches based on receiving the signal.

Because the conductor may be provided without the presence of a cylinder, shaft, lock body, or any other structure that creates an excessive thermal bridge between the conditioned environment at the inner portion of the door to the ambient environment at the outer portion of the door, the presently disclose systems and methods may more effectively prevent conditioned air from escaping from the conditioned environment to the ambient environment, resulting in increased efficiency and performance. Moreover, the conductor may be provided without plastic or non-metal materials, thus avoiding the expense of manufacturing and/or molding the plastic or non-metal materials and avoiding the durability issues associated with the plastic or non-metal materials.

Turning now to the drawings, FIG. 1 illustrates a conditioned air system 8, such as a heating, ventilation, and/or air conditioning (HVAC) system, for building environmental management that may employ one or more HVAC units. In the illustrated embodiment, a building 10 is air conditioned by the conditioned air system 8 that includes a conditioned air unit or HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may include a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56. In any case, the HVAC unit 12, the outdoor HVAC unit 58, and/or the indoor HVAC unit 56 may include a housing or cabinet 13 that contains the various components of the respective HVAC unit to, for example, secure the components, prevent access to the components by unauthorized personnel, protect the components from environmental conditions.

The HVAC unit 12 may be an air cooled device that implements a refrigeration cycle to provide conditioned air to the building 10. For example, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the air is conditioned, the HVAC unit 12 may supply the conditioned air to the building 10 via ductwork 14 extending throughout the building 10 from the HVAC unit 12. For example, the ductwork 14 may extend to various individual floors or other sections of the building 10. In some embodiments, the HVAC unit 12 may include a heat pump that provides both heating and cooling to the building 10, for example, with one refrigeration circuit implemented to operate in multiple different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other equipment, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and/or the like. Moreover, the control device 16 may include computer systems that are integrated with or separate from other building control or monitoring systems, and even systems that are remote from the building 10. In some embodiments, the HVAC unit 12 may operate in multiple zones of the building, and be coupled to multiple control devices that each control flow of air in a respective zone. For example, a first control device 16 may control the flow of air in a first zone 17 of the building, a second control device 18 may control the flow of air in a second zone 19 of the building, and a third control device 20 may control the flow of air in a third zone 21 of the building.

Figure 2:
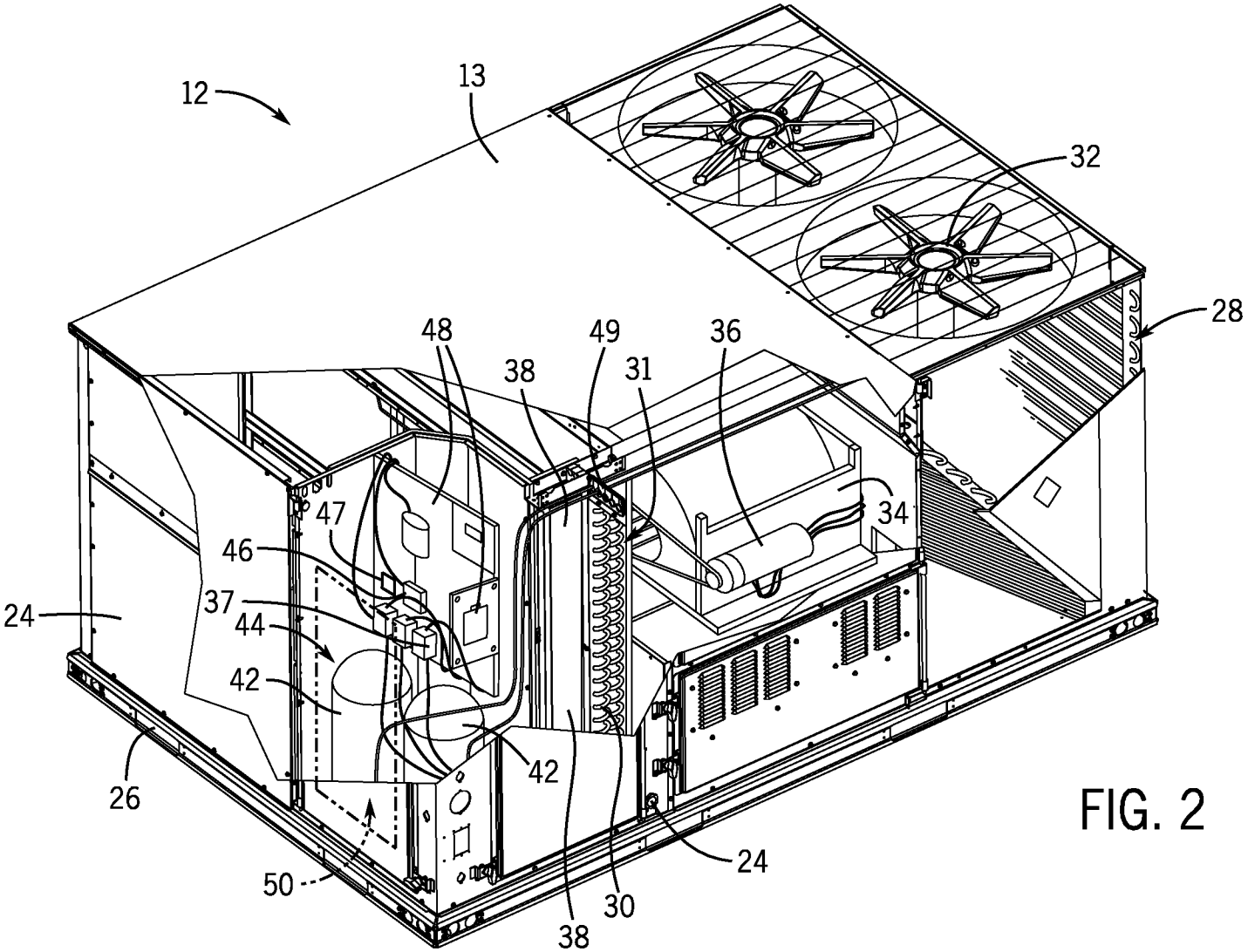
FIG. 2 is a perspective view of a HVAC unit of the HVAC system of FIG. 1, in accordance with an embodiment of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, and/or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12, for example, to provide structural support and/or protect the internal components from environmental contaminant and/or other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements, such as rain, from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and/or the like. Together, the heat exchangers 28 and 30 may implement a thermal cycle in which the refrigerant undergoes phase changes and/or temperature changes as it flows through the heat exchangers 28 and 30 to produce heated and/or cooled air.

For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 may draw air from the environment through the heat exchanger 28. As it flows through the heat exchanger 28, air may be heated or cooled before being released back to the environment surrounding the rooftop unit 12. Each fan 32 may be coupled to a blower assembly 34, which is powered by a respective motor 36, and may draw air through the heat exchanger 30 to heat or cool the air. Each motor 36 may be coupled to a respective variable frequency drive 37 that controls the speed of the motor 36 by adjusting the frequency of electrical power supplied to the respective motor 36.

The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to reduce likelihood of contaminants contacting the heat exchanger 30.

The HVAC unit 12 also may include other equipment for implementing the thermal cycle. Compressors 42 may increase the pressure and/or temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and/or devices may be included in the HVAC unit 12, such as a solid-core filter drier, a drain pan, a disconnect switch, an economizer, pressure switches, phase monitors, and humidity sensors, among other things.

The HVAC unit 12 may receive electrical power via a terminal block 46. For example, a high voltage power source may be connected to the terminal block 46 to power the equipment. The terminal block 46 may be coupled to each variable frequency drive (VFD) 37 to provide power to the respective variable frequency drive 37. The operation of the HVAC unit 12 may be governed or regulated by a control board 48. The control board 48 may include control circuitry connected to a thermostat, a sensor, an alarm, and/or a variable frequency drive 37. One or more of these components may be referred to herein separately or collectively as the control device 16. The control circuitry may control operation of the equipment, provide alarms, and/or monitor safety switches. For example, as illustrated, the control board 48 is communicatively coupled to a VFD control unit 47 that may in turn be communicatively coupled to each controller of each variable frequency drive 37. As such, operation of each variable frequency drive 37 may be managed and/or configured via the VFD control unit 47. Wiring 49 may connect the control board 48 and the terminal block 46 to the equipment of the HVAC unit 12.

The housing 13 of the HVAC unit 12 may include one or more doors 50 that enable access to any of the components of the HVAC unit 12 discussed above. For example, HVAC service personnel may open the one or more doors 50 to maintain, fix, replace components of, and/or change settings of the HVAC unit 12.

Figure 3:
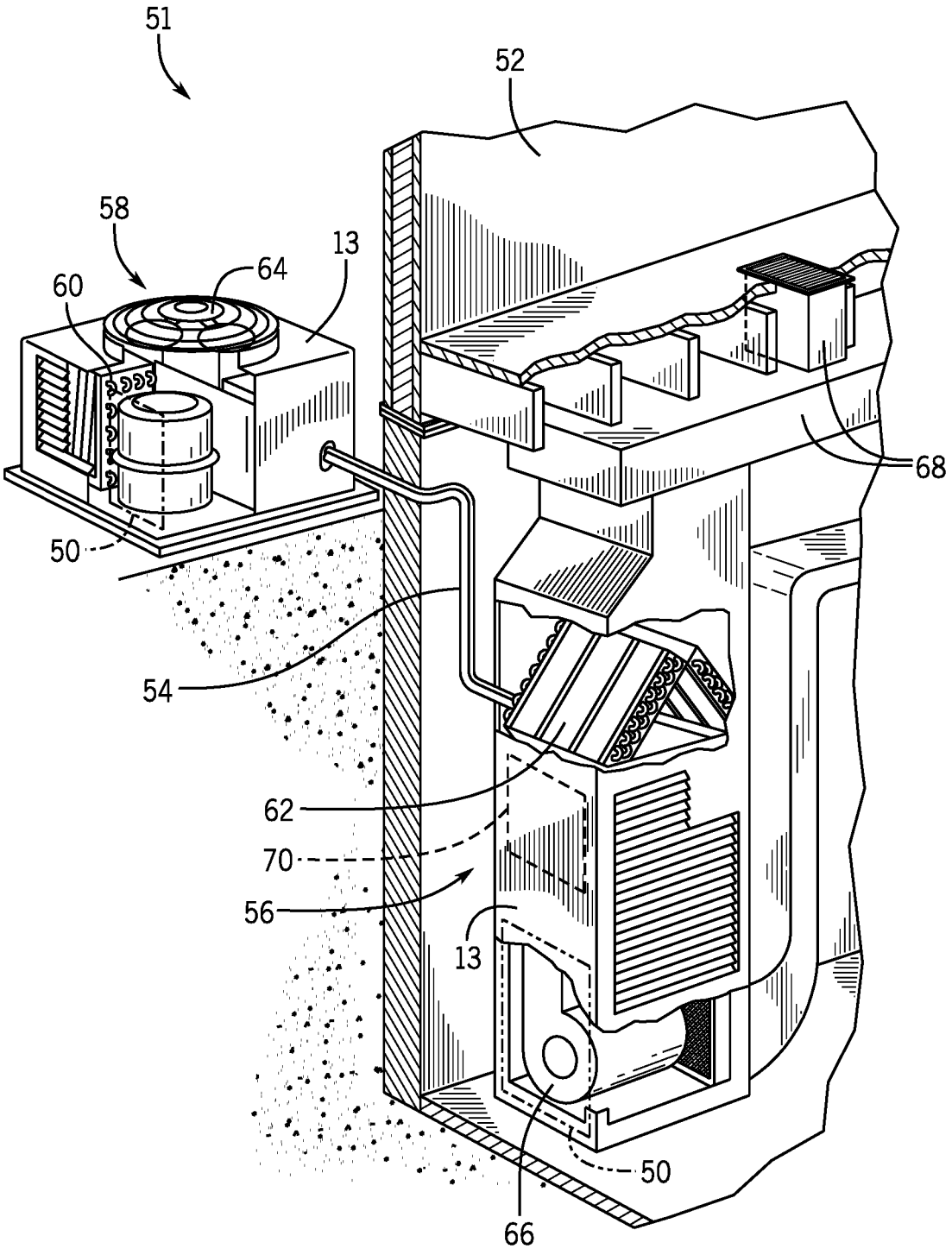
FIG. 3 illustrates a residential heating and cooling system, in accordance with an embodiment of the present disclosure.

FIG. 3 illustrates a residential heating and cooling system 51, also in accordance with present techniques. The residential heating and cooling system 51 may provide heated air to a residential structure, cooled air to a residential structure, ventilation for the residential structure, and/or improved indoor air quality (IAQ) through devices, such as ultraviolet lights and/or air filters. In the illustrated embodiment, the residential heating and cooling system 51 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 may transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 may serve as a condenser for re-condensing vaporized refrigerant flowing from the indoor unit 56 to the outdoor unit 58 via one of the refrigerant conduits 54. In these applications, a heat exchanger 62 of the indoor unit may function as an evaporator. Specifically, the heat exchanger 62 may receive liquid refrigerant, which may be expanded by an expansion device, and evaporate the refrigerant before returning it to the outdoor unit 58.

The outdoor unit 58 may draw environmental air through the heat exchanger 60 using a fan 64 and expel the air above the outdoor unit 58. When operating in an air conditioner mode, the air heated by the heat exchanger 60 within the outdoor unit 58 exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52.

The overall system operates to maintain a desired temperature as set by a system controller. When the temperature sensed inside the residence 52 is higher than the setpoint on the thermostat, or the setpoint plus a small amount, the residential heating and cooling system 51 may become operative to refrigerate or cool additional air for circulation through the residence 52. When the temperature reaches the setpoint, or the setpoint minus a small amount, the residential heating and cooling system 51 may stop the refrigeration cycle temporarily.

The residential heating and cooling system 51 may also operate in a heat pump mode. When operating in the heat pump mode, the roles of heat exchangers 60 and 62 may be reversed. That is, the heat exchanger 60 of the outdoor unit 58 may serve as an evaporator to evaporate refrigerant and thereby cool air entering the outdoor unit 58 as the air passes over outdoor the heat exchanger 60. The indoor heat exchanger 62 may receive a stream of air blown over it and heat the air by condensing the refrigerant.

In some embodiments, the indoor unit 56 may include a furnace system 70. For example, the indoor unit 56 may include the furnace system 70 when the residential heating and cooling system 51 is not implemented to operate as a heat pump. The furnace system 70 may include a burner assembly and heat exchanger, among other components, inside the indoor unit 56. Fuel may be provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

The description above with reference to FIGS. 1-3 is intended to be illustrative of the context of the present disclosure. The techniques of the present disclosure may update features of the description above. In particular, as will be discussed in more detail below, the present disclosure provides an electronic door latch for an HVAC system.

Figure 4:
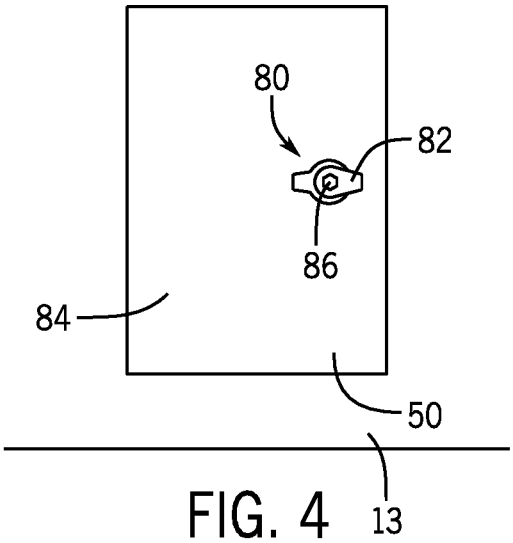
FIG. 4 is a schematic perspective view of a door of the HVAC system of FIG. 1, the HVAC unit of FIG. 2, the residential heating and cooling system of FIG. 3, and/or any other suitable HVAC unit or system, according to embodiments of the present disclosure.

FIG. 4 is a schematic perspective view of a door 50 of the HVAC system 8 of FIG. 1, the HVAC unit 12 of FIG. 2, the residential heating and cooling system 51 of FIG. 3, and/or any other suitable HVAC unit or system, according to embodiments of the present disclosure. The door 50 may be coupled to a housing 13 of the respective HVAC system or unit to enable access to the components of the respective HVAC system or unit. The door 50 may include an electronic locking device or lock 80 that secures the components of the respective HVAC system or unit by allowing access to the components to authorized personnel, such as those with an appropriate key. In particular, the lock 80 may include a locking engagement device 82 disposed on an outer portion or surface 84 of the door 50 that enables operation of the lock 80 via the key. The locking engagement device 82 may include a key receptacle, socket, or hollow 86 that is configured, shaped, and/or dimensioned to enable the key to operate or rotate the lock 80, but prevent other devices from operating the lock 80. In some embodiments, the lock 80 may not include the locking engagement device 82, and instead may be operable via a wireless communication device using appropriate credentials, such as appropriate login and password information. In such cases, the locking engagement device 82 may be referred to as a virtual lock implemented in software or instructions executable by a processor or processing device.

Figure 5:
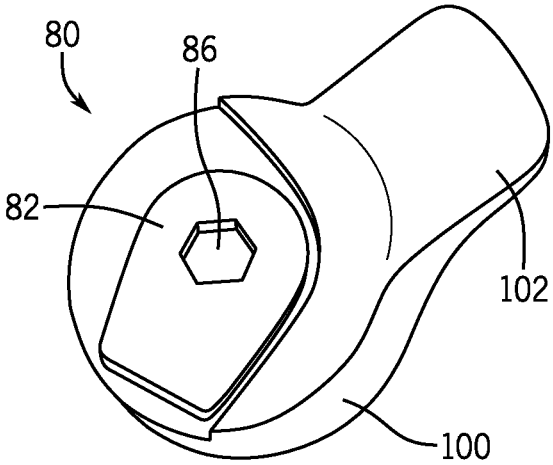
FIG. 5 is a schematic perspective view of a lock of the door of FIG. 4, according to embodiments of the present disclosure.

FIG. 5 is a schematic perspective view of the lock 80 of the door 50 of FIG. 4, according to embodiments of the present disclosure. As illustrated, the lock 80 may include a base 100 fixedly mounted to the outer portion 84, such as an outer surface, of the door 50. For convenience, the base 100 may include a finger pull or pull tab 102 that facilitates pulling the door 50 open. The locking engagement device 82 may be rotatable relative to the base 100, as well as the door 50. In particular, the locking engagement device 82 may include the key receptacle 86 that is configured to enable insertion of a key to fit in the socket or hollow 86, and operate the lock 80. That is, by inserting the key into the socket 86 and rotating the key and the socket 86, the locking engagement device 82 may be rotated into an open (or first) position or a closed (or second) position. Rotating the locking engagement device 82 into the open position may send a signal via a conductor electronically coupling the locking engagement device 82 and a latching system to the latching system to disengage a latch. Similarly, rotating the locking engagement device 82 into the closed position may send a signal via the conductor to the latching system to engage the latch. The socket 86 is illustrated in the shape of a hexagon, and intended, in this embodiment, to enable a hex key, Allen key, or Allen wrench to operate the lock 80. However, it should be understood that any suitable shape and/or dimensions of the socket 86 are contemplated, such as a flathead screwdriver, a Phillips or cross head screwdriver, or other tool, or a key bit or blade.

Figure 6:
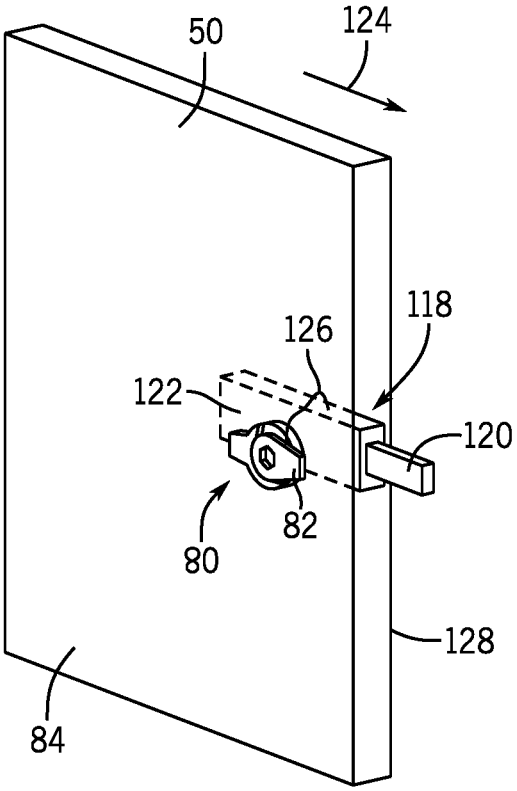
FIG. 6 is a schematic perspective view of the lock of FIG. 4 having a latching system with a latch operable by an actuator in an engaged position, according to embodiments of the present disclosure.

FIG. 6 is a schematic perspective view of the lock 80 of FIG. 4 having a latching system 118 with a latch 120 operable by an actuator 122 in an engaged position, according to embodiments of the present disclosure. In the engaged position, the latch 120 may extend to facilitate engagement with another component, such as a part of the housing 13, to facilitate fixing the door 50 in a closed configuration relative to the overall HVAC system or unit. As illustrated, the locking engagement device 82 is in a closed position because it is pointed in a first or horizontal direction 124. The locking engagement device 82 may be electrically coupled to the actuator 122 of the latching system 118 via a conductor or wire 126. As such, the locking engagement device 82 may send an indication or signal that it is in the closed position via the conductor 126 to the latching system 118. In response to receiving the indication or the signal that the locking engagement device 82 is in the closed position via the conductor 126, the actuator 122 may engage the latch 120. The conductor 126 may be made of any suitable material that transmits the indication or the signal that the locking engagement device 82 is in the closed or an open position to the latching system 118, such as copper, aluminum, and so on. In some embodiments, the conductor 126 may be sheathed in any suitable insulation material to maintain the signal transmitted over the conductor 126, such as a thermoplastic material or a thermoset material. The housing 13 of the HVAC system or unit may include a latch receptacle that receives the latch 120 extended by the actuator 122, thus securing the door 50 and preventing unauthorized access to components of the HVAC system or unit. At least some components of the latching system 118 may be disposed on an inner portion or surface 128 of the door 50, which may include being embedded in and/or within an interior the door 50 itself.

Figure 7:
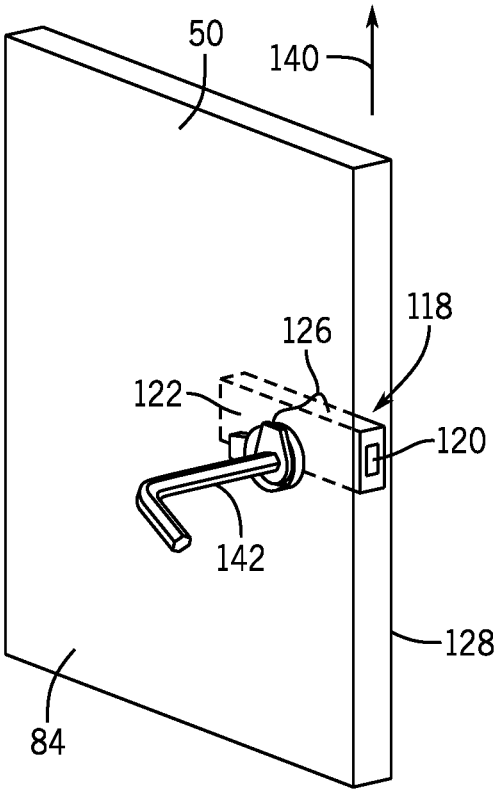
FIG. 7 is a schematic perspective view of the lock of FIG. 4 having the latching system with the latch operable by the actuator in a disengaged position, according to embodiments of the present disclosure.

FIG. 7 is a schematic perspective view of the lock 80 of FIG. 4 having the latching system 118 with the latch 120 operable by the actuator 122 in a disengaged position, according to embodiments of the present disclosure. In the illustrated embodiment, the locking engagement device 82 is in an open position because it is pointed in a second or vertical direction 140. As such, the locking engagement device 82 may send an indication or signal that it is in the open position via the conductor 126 to the latching system 118. In response to receiving the indication or the signal that the locking engagement device 82 is in the open position via the conductor 126, the actuator 122 may disengage the latch 120. As illustrated, a hex key 142 is used to place or rotate the locking engagement device 82 into the open position, though any suitable key that is capable of fitting in the socket 86 and operating the locking engagement device 82 is contemplated.

The actuator 122 is illustrated as a linear actuator, though any suitable actuator that may move the latch 120 into an engaged position to secure the door 50 and prevent unauthorized access to components of the HVAC system or unit and into a disengaged position is contemplated, including, for example, a rotating actuator. That is, the actuator 122 may rotate the latch 120 into an engaged position, such as into a latch receptacle of the housing 13 of the HVAC system or unit, to secure the door 50, and rotate the latch 120 into a disengaged position, such as out of the latch receptacle. Moreover, the actuator 122 may be powered by any suitable technique and, as such, the actuator 122 may be an electrical actuator, a pneumatic actuator, a hydraulic actuator, or a mechanical actuator.

Figure 8:
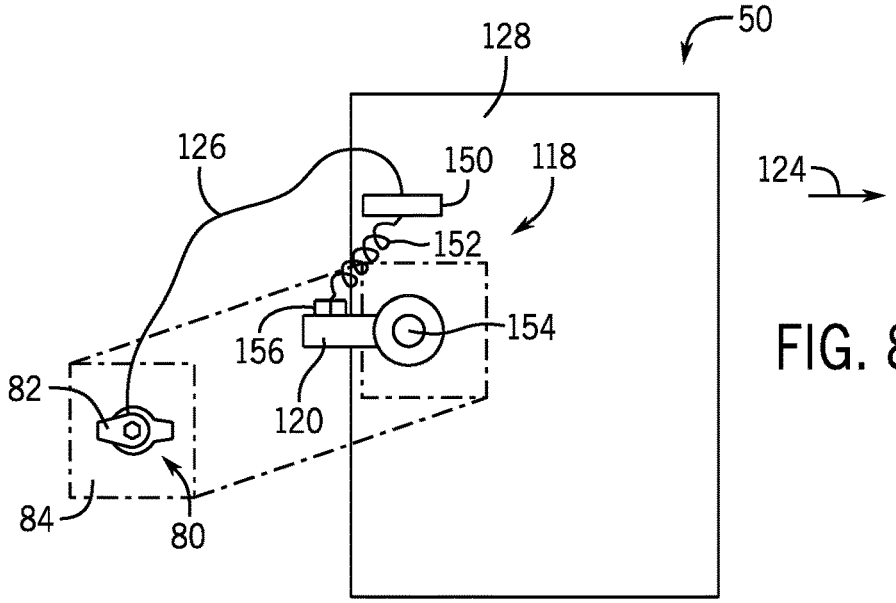
FIG. 8 is a schematic perspective view of the lock of FIG. 4 having the latching system with the latch operable using an electromagnet and a biasing element in an engaged position, according to embodiments of the present disclosure.

In alternative or additional embodiments, the latch 120 may use any other suitable techniques to operate the locking engagement device 82. For example, FIG. 8 is a schematic perspective view of the lock 80 of FIG. 4 having the latching system 118 with the latch 120 operable using an electromagnet 150 and a biasing element 152 in an engaged position, according to embodiments of the present disclosure. As illustrated, the locking engagement device 82 disposed on the outer portion 84 of the door 50 is in the closed position because it is pointed in the first or horizontal direction 124. The locking engagement device 82 disposed on the inner portion 128 of or within the door 50 may be electrically coupled to the electromagnet 150 of the latching system 118 via the conductor 126. The electromagnet 150 may emit a magnetic field when it receives current via the conductor 126, and does not emit a magnetic field when it does not receive current via the conductor 126. In the illustrated embodiment, the locking engagement device 82 may send current via the conductor 126 to the latching system 118 when the locking engagement device 82 is in the open position. As such, because the locking engagement device 82 is in the closed position, the electromagnet 150 does not emit a magnetic field. Additionally, the latching system 118 may include a magnet 156 and a biasing element 152. The magnet 156 may be a permanent magnet, and the biasing element 152 may couple the electromagnet 150 to the magnet 156. As illustrated, the biasing element 152 exerts a force urging the magnet 156 away from the electromagnet 150, thus urging the latch 120 into the engaged position. While the biasing element 152 is illustrated as a compression spring, any suitable device that urges the latch 120 into the closed position is contemplated, such as a torsion spring, a leaf spring, and so on. The housing 13 of the HVAC system or unit may include a latch receptacle that receives the latch 120 urged into the engaged position by the biasing element 152, thus securing the door 50 and preventing unauthorized access to components of the HVAC system or unit.

Figure 9:
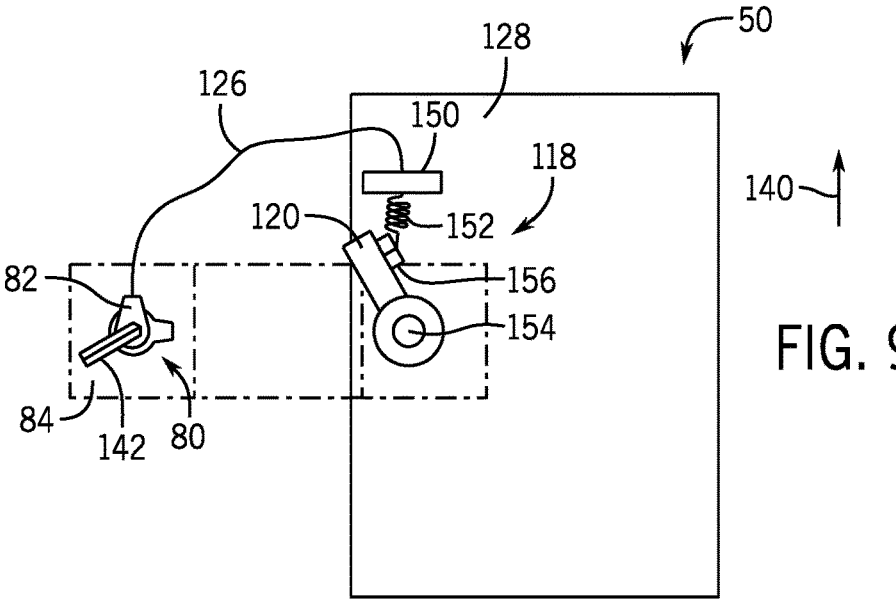
FIG. 9 is a schematic perspective view of the lock of FIG. 4 having the latching system with the latch operable using the electromagnet and the biasing element in a disengaged position, according to embodiments of the present disclosure.

FIG. 9 is a schematic perspective view of the lock 80 of FIG. 4 having the latching system 118 with the latch 120 operable using the electromagnet 150 and the biasing element 152 in a disengaged position, according to embodiments of the present disclosure. As illustrated, the locking engagement device 82 disposed on the outer portion 84 of the door 50 is in the open position because it is pointed in the second or vertical direction 140. As such, because the locking engagement device 82 is in the open position, the locking engagement device 82 may send current via the conductor 126 to the latching system 118 to cause the electromagnet 150 to emit a magnetic field. The magnetic field emitted by the electromagnet 150 may attract the magnetic field of the magnet 156, urging the magnet 156, and thus the latch 120, toward the electromagnet 150. Specifically, the strength of the magnetic field emitted by the electromagnet 150 attracting the magnet 156 thereto may be greater than the strength of the force exerted by the biasing element 152 urging the magnet 156 away from the electromagnet 150, thus urging the magnet 156 toward the electromagnet 150 and disengaging the latch 120.

While the biasing element 152 is shown to couple the magnet 156 and the electromagnet 150 together, it should be understood that the biasing element 152 may couple together any suitable components that enable engagement and disengagement of the latch 120, such as the inner portion 128 of the door 50 and the latch 120. Moreover, while the magnet 156 is shown attached to the latch 120, in some embodiments, for example, at least a portion of the latch 120 may act as the magnet 156, such that there may be no separate magnet 156 attached to the latch 120. Additionally or alternatively, the biasing element 152 and the electromagnet 150 may perform the opposite functions as those shown in FIGS. 8-9. That is, the biasing element 152 may instead exert a force that urges the magnet 156 toward the electromagnet 150, while the electromagnet 150, when supplied with current via the conductor 126 emits a magnetic field that repulses the magnet 156. In such an embodiment, the locking engagement device 82 may send the current to the latching system 118 via the conductor 126 to engage the latch 120.

Figure 10:
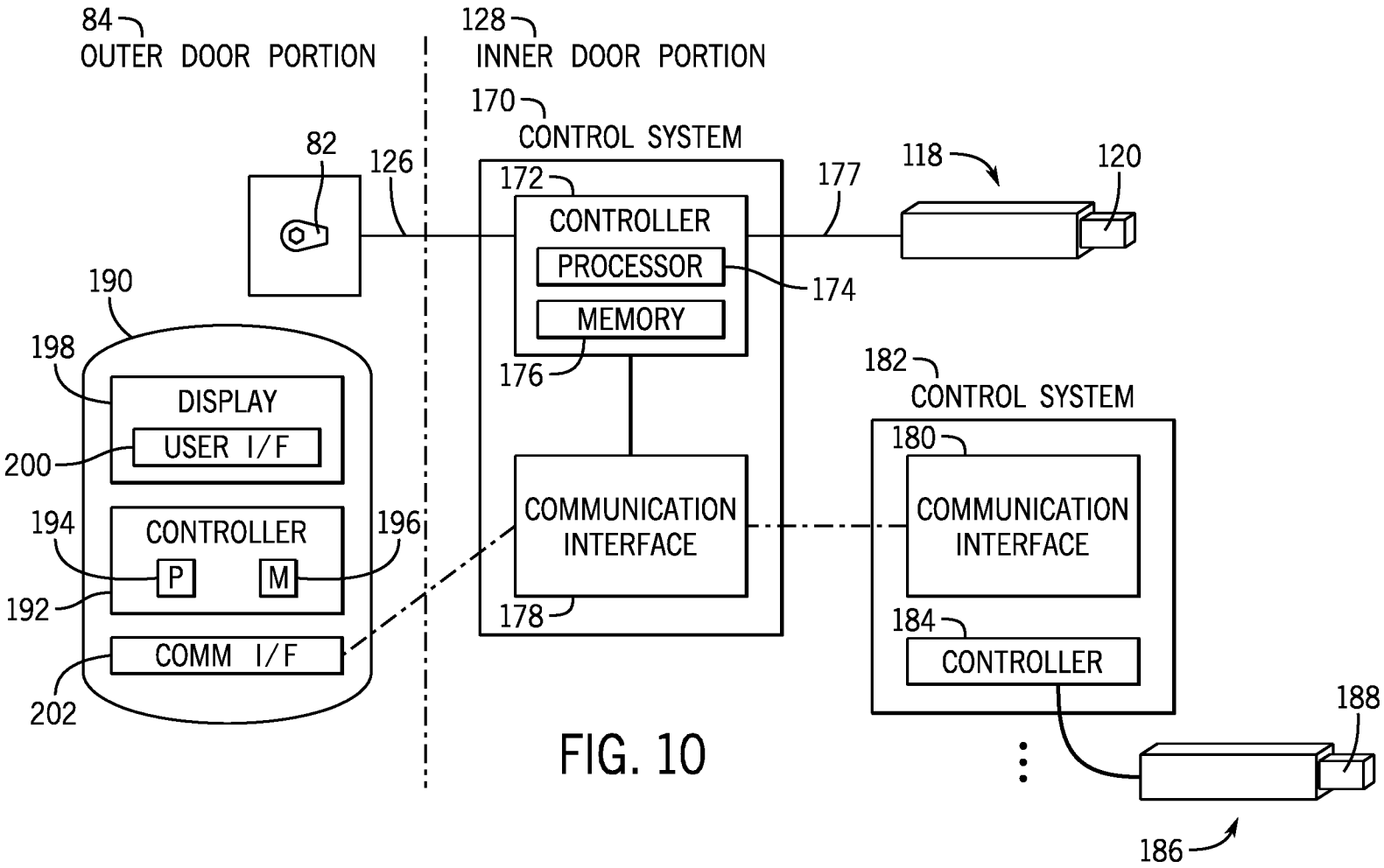
FIG. 10 is a block diagram of a control system that operates the latching system of FIG. 6 based on a signal sent from the locking engagement device via a conductor, according to embodiments of the present disclosure.

The embodiments disclosed above include directly electrically coupling the latching system 118 to the locking engagement device 82, such that the indication, signal, or current sent by the locking engagement device 82 is received directly by the latching system 118 via the conductor 126, without an intermediate device receiving the indication, signal, or current sent from the locking engagement device 82 and forwarding the indication, signal, or current to the latching system 118. However, in some embodiments, a controller may receive the indication, signal, or current from the locking engagement device 82 and send the indication, signal, or current to the latching system 118. For example, FIG. 10 is a block diagram of a control system 170 that operates the latching system 118 of FIG. 6 based on a signal sent from the locking engagement device 82 via the conductor 126, according to embodiments of the present disclosure. While the control system 170 is illustrated as disposed on the inner door portion 128, it should be understood that the control system 170 may be disposed in any suitable location, such as within the door 50, contained within the housing 13 of the HVAC system or unit, and so on.

As illustrated, the control system 170 includes a controller 172 that may receive a signal, current, or indication of the position of the locking engagement device 82 via the conductor 126. The controller 172 may include a processor 174, which may include any type of processing circuitry, such as one or more processors, one or more general-purpose microprocessors, one or more special-purpose microprocessors, and/or one or more application specific integrated circuits (ASICS), or some combination thereof. For example, the processor 174 may include one or more reduced instruction set (RISC) processors. The controller 172 may also include a memory device 176. The memory device 176 may include any suitable type of memory that stores instructions (e.g., software) executable by the processor 174, such as a non-volatile and/or volatile memory. In particular, the memory device 176 may store instructions that, when executed by the processor 174, cause the processor 174 to receive the signal, current, or indication of the position of the locking engagement device 82 via the conductor 126, and operate the latching system 118 by, for example, engaging or disengaging the latch 120 of the latching system 118, based on the signal, current, or indication of the position of the locking engagement device 82.

The controller 172 may be electrically coupled to the latching system 118 via, for example, a second conductor 177. As such, in response to receiving a signal, current, or indication of the position of the locking engagement device 82 via the conductor 126, the controller 172 may send an instruction or signal to the latching system 118 to engage or disengage the latch 120. For example, if the indication is associated with the locking engagement device 82 being in the open position, the controller 172 may instruct the latching system 118 to disengage a respective latch 188 via the second conductor 177, thus enabling the door 50 to be opened and enabling access to components contained in the housing 13 of the HVAC system or unit. If the indication is associated with the locking engagement device 82 being in the closed position, the controller 172 may instruct the latching system 118 to engage the respective latch 188 via the second conductor 177, thus preventing the door 50 from opening and preventing access to components contained in the housing 13 of the HVAC system or unit. Similar to the conductor 126, the second conductor 177 may be made of any suitable material that transmits the instruction or signal to the latching system 118 to engage or disengage the latch 120, such as copper, aluminum, and so on. In some embodiments, the second conductor 177 may be sheathed in any suitable insulation material to maintain the signal transmitted over the second conductor 177, such as a thermoplastic material or a thermoset material.

In some embodiments, the controller 172 may be communicatively coupled to a communication interface 178 that may enable communication with any suitable communication network, such as a wiring terminal, a cellular network, a WiFi network, a personal area network (PAN), a local area network (LAN), a wide area network (WAN), and/or the like. For example, the communication interface 178 may enable the controller 172 to communicatively couple to a second communication interface 180 of a second control system 182 via a suitable communication network. As such, the controller 172 may instruct a second controller 184 of the second control system 182 to operate a second latching system 186 by, for example, engaging or disengaging a second latch 188 of the second latching system 186, based on the signal, current, or indication of the position of the locking engagement device 82, via the communication interface 178 and the second communication interface 180. While a second control system 182 is shown in FIG. 10 to be communicatively coupled to the communication interface 178 via a second communication interface 180, it should be understood that any suitable number of control systems 182 may be communicatively coupled to the communication interface 178 via respective communication interfaces to operate respective latching systems.

In additional or alternative embodiments, a computing device 190 may be communicatively coupled to the control system 170. For example, the computing device 190 may include desktop computer, a personal computer, or a mobile computing device, such as a cell phone, a smartphone, a wearable device, a tablet, or a laptop. As illustrated, the computing device 190 may include a controller 192 that controls operations of the computing device 190. The controller 192 may include a processor 194 and a memory device 196. The processor 194 may include any suitable type of processing circuitry, such as one or more processors, one or more general-purpose microprocessors, one or more special-purpose microprocessors, and/or one or more application specific integrated circuits (ASICS), or some combination thereof. For example, the processor 194 may include one or more reduced instruction set (RISC) processors. The memory device 196 may include any suitable type of memory that stores instructions, such as in the form of software, executable by the processor 194, such as a non-volatile and/or volatile memory.

The controller 192 may be coupled to an electronic display 198 that enables a user to view information associated with the computing device 190. The display 198 may include a user interface 200 that enables a user to input information to the computing device 190. In alternative or additional embodiments, any suitable input device or technique may be used to receive input from a user, such as a keyboard, mousing device, trackpad, and so on.

The controller 192 may be coupled to a communication interface 202 that enables the computing device 190 to communicate with other electronic devices. For example, the communication interface 202 may enable the computing device 190 to communicate with any suitable communication network to communicatively couple to another electronic device. As such, the communication interface 202 may enable the computing device controller 192 to communicate with wireless networks, such as a mobile, WiFi, LAN, WAN, or Internet network, through which the computing device controller 192 may communicatively couple to the communication interface 178 of the control system 170. The communication interface 202 may also or alternatively enable the computing device controller 192 to communicatively couple to the communication interface 178 of the control system 170 through wire-based communication technology, such as Ethernet, RS-232, RS-485, UART, USART, or USB technology.

As such, the communication interface 202 may enable the computing device 190 to operate the latching system 118 by, for example, engaging or disengaging the latch 120 of the latching system 118, based on the signal, current, or indication of the position of the locking engagement device 82 via the controller 172 and the communication interface 178. In particular, the user interface 200 may display controls, such as buttons or switches, which are associated with engaging or disengaging the latch 120 of the latching system 118. The computing device controller 192 may receive an indication or signal from user interface 200 as to whether a control is placed in an open (or first) or closed (or second) position. The computing device controller 192 may then instruct the controller 172 of the control system 170 to engage or disengage the latch 120 via the communication interface 202 and the communication interface 178. As such, the user interface 200 may enable, for example, a user, to engage or disengage the latch 120 via the computing device 190. In such an embodiment, the outer door portion 84 may or may not include the locking engagement device 82, as it may be superfluous, but could still be used as a redundant way to engage or disengage the latch 120. The user interface 200 may be referred to as a virtual lock, and thus may use security techniques, such as appropriate login and password information, biometric information, and so on, to enable use of the user interface 200 to engage or disengage the latch 120.

Figure 11:
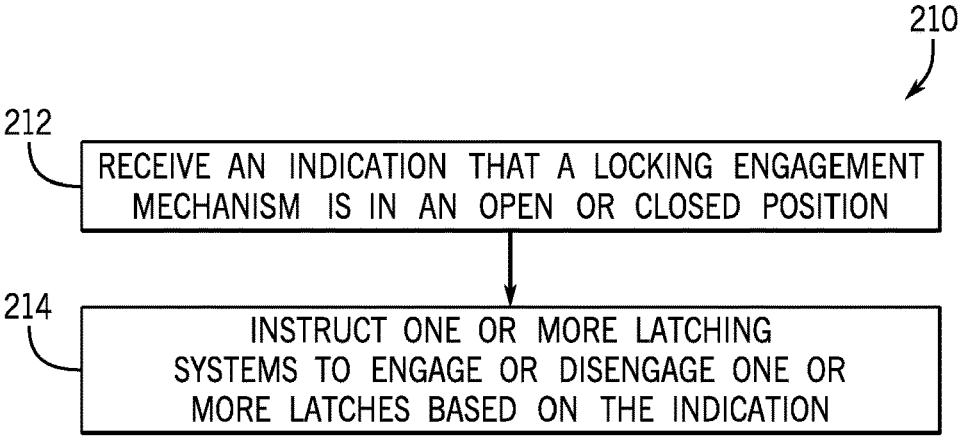
FIG. 11 is a flow diagram of a process for operating the latching system of FIG. 10, according to embodiments of the present disclosure.

With the foregoing in mind, FIG. 11 is a flow diagram of a process 210 for operating the one or more latching systems 118 of FIG. 10, according to embodiments of the present disclosure. While the process 210 is described using steps in a specific sequence, it should be understood that the present disclosure contemplates that the described steps may be performed in different sequences than the sequence illustrated, and certain described steps may be skipped or not performed altogether. In some embodiments, the process 210 may be implemented by executing instructions stored in a tangible, non-transitory, computer-readable medium, such as the memory device 176, using a processor, such as the processor 174 of the controller 172.

As illustrated, the processor 174 receives, at process block 212, an indication that a locking engagement device 82 is in an open (or first) or closed (or second) position. In particular, a user may place or rotate the locking engagement device 82 into the open or closed position. In response to the locking engagement device 82 being placed or rotated into the open or closed position, the locking engagement device 82 may send an indication of or a signal associated with the position via the conductor 126 to the processor 174.

In process block 214, the processor 174 instructs one or more latching systems 118 to engage or disengage one or more latches 188 of the one or more latching systems 118 based on the indication. For example, if the indication is associated with the locking engagement device 82 being in the open position, the processor 174 may instruct a latching system 118 to disengage a respective latch 188, thus enabling the door 50 to be opened and enabling access to components contained in the housing 13 of the HVAC system or unit. If the indication is associated with the locking engagement device 82 being in the closed position, the processor 174 may instruct the latching system 118 to engage the respective latch 188, thus preventing the door 50 from opening and preventing access to components contained in the housing 13 of the HVAC system or unit. In some embodiments, the processor 174 may be directly and electrically coupled to the latching system 118 via, for example, the second conductor 177 of FIG. 10. In alternative or additional embodiments, the processor 174 may instead or also be electrically coupled to additional latching systems 186 via, for example, the communication interface 178, a communication network, additional communication interfaces 180, and additional controllers 184 of additional control systems 182, as shown in FIG. 10. As such, the processor 174 may instruct the additional controllers 184 to engage or disengage additional latches 188 of the additional latching systems 186 by sending an instruction to the communication interface 178, over a communication network, to the additional communication interfaces 180, and to the additional latching systems 186.

In some cases, the processor 174 may control other components of the HVAC system or unit, such as other components contained in the housing 13 of the HVAC system or unit, based on engaging or disengaging the one or more latches 188 of the one or more latching systems 118 and/or opening or closing the one or more doors 50 of the housing 13. For example, an HVAC system may include ultraviolet lights that reduce microbial growth in a portion (e.g., an evaporator section) of the HVAC system. However, it may be undesirable for a human (e.g., service personnel or owners of the HVAC system) to be exposed to the ultraviolet lights. As such, the processor 174 may be communicatively coupled to a switch (e.g., an interlock switch) that controls operation of the ultraviolet lights, such that when the processor 174 disengages the one or more latches 188 (and/or receives an indication or determines that the one or more doors 50 are opened), the processor 174 may switch or turn off ultraviolet lights associated with the one or more doors 50 (and/or other nearby doors) corresponding to the one or more latches 188.

Additionally or alternatively, the processor 174 may override the presently disclosed control schemes of the latches 188 (e.g., the process 210) in certain circumstances. For example, if the interlock switch that controls the operation of the ultraviolet lights described above fails to switch or turn off the ultraviolet lights, the processor 174 may override disengagement of the latches 188 (and/or prevent the one or more doors 50 from being opened) to ensure that the service personnel or owners of the HVAC system are not exposed to the ultraviolet lights.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A heating, ventilation, and air conditioning (HVAC) system comprising:

a housing configured to contain components of the HVAC system, wherein the housing comprises a door configured to enable access to the components of the HVAC system, wherein the door comprises:

an outer portion including a locking engagement device;

an inner portion including a latching system, wherein the latching system comprises a latch, wherein the latch is configured to prevent the door from opening when engaged; and a conductor electrically coupling the locking engagement device to the latching system, wherein the latching system is configured to disengage the latch in response to the locking engagement device being in a first position and the latching system is configured to engage the latch in response to the locking engagement device being in a second position.

2. The HVAC system of claim 1, wherein the latching system comprises a rotatable mount configured to rotatably mount the latch to the inner portion of the door.

3. The HVAC system of claim 1, wherein the latching system comprises:

a magnet coupled to the latch;

a biasing element coupled to the latch or the magnet, wherein the biasing element exerts a force that urges the latch toward an engaged position; and an electromagnet configured to produce a magnetic field that attracts the magnet, wherein the magnetic field is configured to urge the latch toward a disengaged position.

4. The HVAC system of claim 3, wherein the electromagnet is electrically coupled to the conductor, wherein the electromagnet is configured to produce the magnetic field in response to the locking engagement device being in the first position, wherein the electromagnet is configured to not produce the magnetic field in response to the locking engagement device being in the second position.

5. The HVAC system of claim 3, wherein a strength of the magnetic field is greater than a strength of the force exerted by the biasing element when the locking engagement device is in the first position.

6. The HVAC system of claim 1, wherein the outer portion of the door is configured to be exposed to an ambient environment.

7. The HVAC system of claim 1, wherein the inner portion of the door is configured to be exposed to an environment conditioned by the HVAC system.

8. The HVAC system of claim 1, wherein at least a portion of the latching system is embedded in the door.

9. The HVAC system of claim 1, wherein the locking engagement device comprises an engagement portion configured to enable a tool to rotate the locking engagement device into the first position and the second position.

10. The HVAC system of claim 9, wherein the tool comprises a hex key.

11. The HVAC system of claim 1, wherein the latching system comprises an actuator electrically coupled to the conductor.

12. The HVAC system of claim 11, wherein the actuator is configured to extend the latch in response to the locking engagement device being in the second position and the actuator is configured to retract the latch in response to the locking engagement device being in the first position.

13. The HVAC system of claim 11, wherein the actuator is configured to rotate the latch into a latch receptacle of the housing in response to the locking engagement device being in the second position and the actuator is configured to rotate the latch out of the latch receptacle in response to the locking engagement device being in the first position.

14. An electronic locking device of a door of a heating, ventilation, and air conditioning (HVAC) system, wherein the electronic locking device comprises:

a locking engagement device disposed on an outer portion of the door;

a latching system disposed on an inner portion of the door, wherein the latching system comprises a latch, wherein the latching system is configured to operate the latch to prevent the door from opening when the latch is engaged; and a conductor electrically coupling the locking engagement device to the latching system, wherein the latching system is configured to disengage the latch in response to the locking engagement device being in a first position and the latching system is configured to engage the latch in response to the locking engagement device being in a second position.

15. The electronic locking device of claim 14, comprising a controller electrically coupled to the conductor, wherein the controller is configured to:

receive an indication transmitted over the conductor that the locking engagement device is in the first position; and instruct the latching system to disengage the latch in response to the indication.

16. The electronic locking device of claim 15, wherein the controller is communicatively coupled to a communication interface, wherein the communication interface is configured to communicatively couple the controller to an additional latching system of an additional door of the HVAC system, wherein the controller is configured to instruct the additional latching system to disengage an additional latch of the additional latching system in response to the indication.

17. The electronic locking device of claim 14, comprising a controller electrically coupled to the conductor, wherein the controller is configured to:

receive an indication transmitted over the conductor that the locking engagement device is in the second position; and instruct the latching system to engage the latch in response to the indication.

18. The electronic locking device of claim 17, wherein the controller is communicatively coupled to a communication interface, wherein the communication interface is configured to communicatively couple the controller to an additional latching system of an additional door of the HVAC system, wherein the controller is configured to instruct the additional latching system to engage an additional latch of the additional latching system in response to the indication.

19. The electronic locking device of claim 14, comprising a controller and a communication interface, wherein the controller is communicatively coupled to the communication interface, wherein the communication interface is configured to:

communicatively couple the controller to a computing device, wherein the controller is configured to receive an instruction from the computing device to engage or disengage the latch; and instruct the latching system to engage or disengage the latch in response to receiving the instruction.

20. A locking engagement device configured to be disposed on an outer portion of a door of a heating, ventilation, and air conditioning (HVAC) system, wherein the locking engagement device comprises:

a receptacle configured to enable insertion of a key, wherein the locking engagement device is configured to rotate in response to the key being inserted in the receptacle and rotated; and a conductor configured to electrically couple the locking engagement device to a latching system disposed on an inner portion of the door, wherein:

the locking engagement device is configured to send a first indication of being in a first position to the latching system via the conductor in response to the locking engagement device being rotated into the first position; and the locking engagement device is configured to send a second indication of being in a second position to the latching system via the conductor in response to the locking engagement device being rotated into the second position.

21. The locking engagement device of claim 20, wherein the latching system comprises a latch, wherein the latching system is configured to operate the latch to prevent the door from opening when the latch is engaged.

22. The locking engagement device of claim 21, wherein the latching system is configured to disengage the latch in response to the locking engagement device being in the first position and the latching system is configured to engage the latch in response to the locking engagement device being in the second position.

23. The locking engagement device of claim 20, wherein at least a portion of the latching system is within an interior of the door.

* * * * *